United States Patent [19]

Kessler

[11] Patent Number: 4,850,497

[45] Date of Patent: Jul. 25, 1989

[54] LINERLESS PLASTIC CLOSURES

[76] Inventor: Ronald M. Kessler, P.O. Box 1858, 1110 Thalia Ave., Youngstown, Ohio 44512

[21] Appl. No.: 196,872

[22] Filed: May 9, 1988

[51] Int. Cl.[4] ..... B65D 53/00

[52] U.S. Cl. ..... 215/329; 215/344; 215/DIG. 1

[58] Field of Search ..... 215/329, 344, DIG. 1

[56] References Cited

U.S. PATENT DOCUMENTS 3,160,303 12/1964 Healy ..... 215/344

3,844,439 10/1974 Demers et al. ..... 215/344

4,673,096 6/1987 Towns et al. ..... 215/344 X

*Primary Examiner*—Donald F. Norton

*Attorney, Agent, or Firm*—Browdy & Neimark

[57] ABSTRACT

An improved linerless plastic closure for large mouthed bottles and jars includes a plurality of ribs, at least one of which is wavy, projecting downwardly from the undersurface of the closure so as to contact the upper edge of the bottle or jar mouth. The wavy ribs give better surface contact with the upper edge of the bottle than conventional circular ribs.

7 Claims, 1 Drawing Sheet

LINERLESS PLASTIC CLOSURES

FIELD OF THE INVENTION

The present invention relates to the improved sealing of containers; and, more particularly, to an improved linerless plastic closure for large mouthed bottles or jars.

FIELD OF INVENTION

Large mouthed bottles or jars, such as for various types of creams and viscous slurries such as polishing compounds, are particularly difficult to seal because the area of peripheral contact between the upper edge of the bottle mouth and the inside of the closure is so large. Of course, it is possible to achieve satisfactory sealing of such large mouthed bottles or jars by the use of liners and the like, but such liners, constituting an added element, significantly increase the costs of the closure. Therefore, it is desirable to provide linerless plastic closures for large mouthed bottles and jars which, however, provide an adequate seal with no danger of leakage.

Two approaches have been attempted in the past with some success. In one approach, a series of small circular ribs are provided projecting downwardly from the undersurface of the closure so as to contact the upper edge of the bottle or jar mouth. In a second approach, the cap is provided with hinges as illustrated in the Morrison U.S. Pat. No. 3,414,151. While both of these approaches give some success, the results are still not fully satisfactory as in a few cases, because of inevitable flaws and even normal manufacturing tolerances, these prior seals are incomplete with leakage resulting.

SUMMARY

It is, accordingly, an object of the invention to overcome deficiencies in the prior art, such as indicated above.

It is another object to provide for the improved sealing of jars and bottles with screw-on caps, without the necessity of using liners.

It is a further object of the present invention to provide an improved linerless plastic closure for large mouthed bottles and jars.

These and other objects and the nature and advantages of the instant invention will be more apparent from the following detailed description of certain embodiments, taken in conjunction with the drawing. Briefly, however, the invention involves the provision of multiple ribs, at least one of which is wavy, projecting downwardly from the undersurface of the closure so as to contact the upper edge of the bottle mouth. The wavy rib gives better surface contact with the upper edge of the bottle or jar neck than the previously used circular rib. The wavy annularly extending rib may be used with plain circular ribs or with additional wavy circularly extending ribs, and also may be used in conjunction with a hinge construction of the character generally disclosed in the aforementioned U.S. Pat. No. 3,414,151.

DETAILED DESCRIPTION OF EMBODIMENTS

Figure 1:
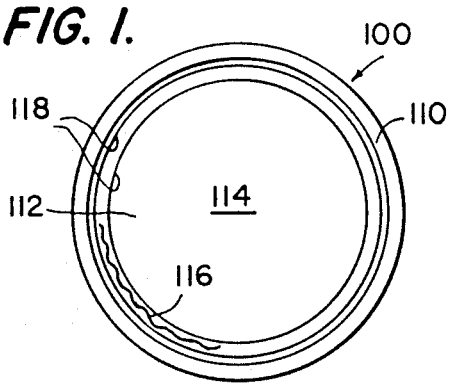
FIG. 1 is a partially schematic bottom view of a plastic bottle cap in accordance with the present invention.

FIG. 1 shows a bottle cap 100 in accordance with the present invention having a downwardly depending skirt 110 which is internally threaded (not shown for purposes of clarity) and a top wall 112, the bottom or inside surface 114 of which is seen. The bottle cap 100 is molded of plastic in a well known and conventional manner, preferably by injection molding of a suitable semi-flexible plastic such as vinyl plastic, polypropylene, polyethylene, polyamide or the like.

As is common, such a bottle cap is screwed over the mouth of a jar and the top edge of the neck portion of the jar comes into mating contact with the surface 114 along its periphery. In accordance with the present invention at least one very fine downwardly projecting wavy rib 116 is provided about the periphery of the surface 114 so as to come into mating engagement with the upper edge of the jar. The annular wavy rib 116, because its length is greater than a circular nonwavy rib at the same location, provides a larger surface contact with the upper edge of the mouth of the jar, and thereby provides improved sealing of the jar opening.

Figure 2:
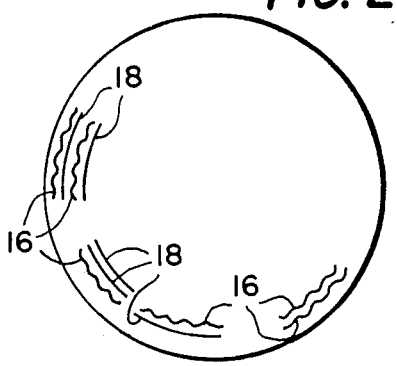
FIG. 2 is a schematic bottom view of a portion of a bottle cap according to the invention showing various embodiments.

In the embodiment 100 of FIG. 1, the wavy rib 116, which extends entirely about the periphery, has a nonwavy rib 118 on either side thereof, so that in this embodiment there are provided a total of three downwardly depending ribs. It will be understood that the greater the number of ribs, the more contact surface there is an the better the sealing; on the other hand, the contact surface between the upper edge of the jar and the inside surface 114 of the cap is very limited in area, so that the total number of downwardly depending ribs is limited to the available space. FIG. 2 schematically illustrates a variety of possibilities including at the ten o'clock position a configuration with two wavy annular ribs 16 and two nonwavy annular ribs 18; at the 8 o'clock position a wavy annular rib 16 encircling two nonwavy annular ribs 18; at the 7 o'clock position a wavy annular rib 16 lying within a nonwavy annular rib 18; and at the 5 o'clock position two wavy annular ribs 16. Of course, various other configurations are possible, and it is preferred that the number of annular ribs be about 4 to 7. It is also preferred that they all be wavy.

The dimensions of the ribs are not critical, except that it should be understood that the height thereof is very small, i.e. on the order of less than 1 mm in accordance with conventional practice for the nonwavy ribs 18, 118. Similarly, the width of these ribs is also very small, normally on the order of about 1 mm or less consistent with the conventional practice for the nonwavy ribs 18, with the spacings therebetween being about the same thickness. The amplitude and frequency of the waves of the ribs 16, 116 also is not critical, although it will be understood that the greater the amplitude and the smaller the frequency the greater the surface contact and, accordingly, the better the result. On the other hand, the amplitude is again limited by the contacting surface area of the upper edge of the jar. It should also be understood that while the wavy rib 16, 116 is illustrated as taking the form of a sine wave, other configurations are possible and, indeed, it is not necessary that the amplitude and frequency be consistent about the entire periphery.

Figure 3:
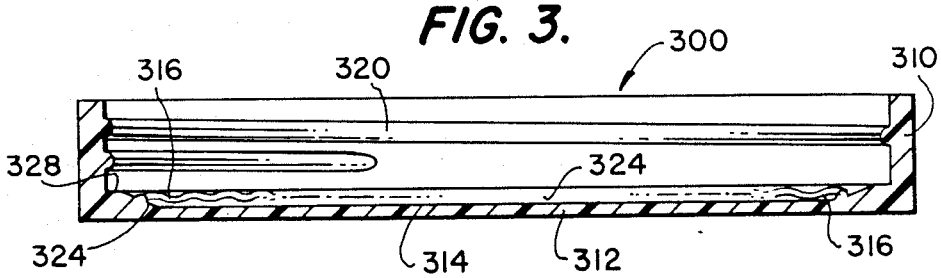
FIG. 3 is a vertical sectional view of another embodiment of a cap in accordance with the present invention.

FIG. 3 is a sectional view of a third jar cap embodiment 300 in which the wavy annular rib 316 extends upwardly from a frustoconical wall 324. The jar cap 300 comprises a peripheral skirt 310 depending downwardly from a top wall 312, the latter of which is provided with an internal surface 314. The downwardly depending peripheral skirt 310 is provided internally with a conventional screw thread 320 for mating engagement with an exterior screw thread on the jar to which the cap 300 is to be applied.

In accordance with the present invention, the closure lid 300 is provided with at least one wavy downwardly depending rib 316 which extends entirely about the interior of the cap in a location where it will come into contact with the upper edge of the jar, just as in the other embodiments discussed above. Only one rib 316 is illustrated in FIG. 3 for purposes of simplicity, but it will be understood that at least two ribs should be present and at least one of these must be a wavy rib 316. It will also be understood that the pattern of the ribs can vary considerably and may be any of those shown in FIG. 2, or may be the pattern shown in FIG. 1, or may be any other pattern. The closure 300 differs from those illustrated in FIGS. 1 and 2 by the nature of the top wall 312 along its periphery, i.e. the provision of the frustoconical portion 324.

Thus, extending outwardly from the main central portion of the inside surface 314 is a downwardly and outwardly projecting annular support wall 324, and it is from this tapered or frustoconical wall 324 which the ribs, including the wavy rib 316, project downwardly as noted above. While the wall 324 (also see the corresponding tapered walls in FIGS. 4 and 5) is shown as having a substantial taper, it will be understood that the taper is exaggerated in the drawings and that in actuality the taper will normally be less than 30°, and usually less than 5°. Outside the frustoconical wall 324 is an annular ledge or shoulder 328.

Figure 3A:
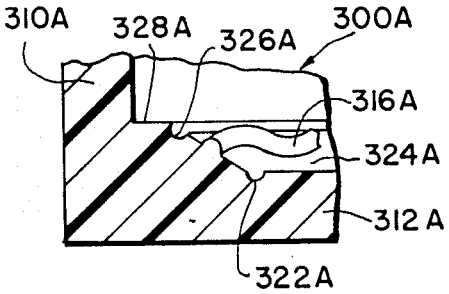
FIGS. 3A and 4–6 are greatly enlarged and exaggerated partial sectional views of corners of other bottle cap embodiments according to the present invention.

FIG. 3A is a partial sectional view of another jar cap embodiment 300A which, in addition to having a wavy rib 316A according to the present invention, is also provided with hinged structure the same as or similar to that of the aforementioned Morrison U.S. Pat. No. 3,414,151. As in the embodiment 300 of FIG. 3, the cap 300A of FIG. 3A has the wavy rib 316A (and its accompanying ribs, not illustrated) depending downwardly from a frustoconical wall 324A.

The closure 300A differs from the closure 300 of FIG. 3 in the provision of suitable hinge means. Thus, the bottom wall 312A is provided with a first or inner annular groove 322A which serves as a first hinge means, this annular groove being located at the inner edge of the frustoconical wall 324A. Similarly, at the outer edge of the frustoconical wall 324A is a second or outer annular groove 326A which serves as a second hinge means. And extending outwardly of the second annular groove 326A to the inside surface of the skirt 310A is an annular ledge 328A.

In use, the closure cap 300A functions in the same as the closure cap 100 of FIG. 1, except that the sealing function provided by the at least one wavy rib 316A is enhanced by the ability of its support surface 324A to slightly flex as disclosed in the above-mentioned Morrison U.S. Pat. No. 3,414,151.

Figure 4:
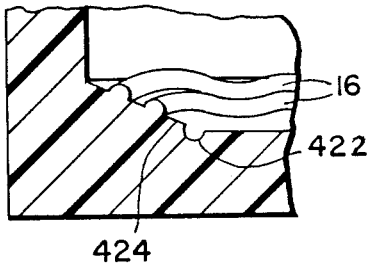
Figure 5:
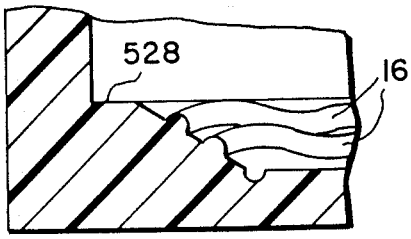
Figure 6:
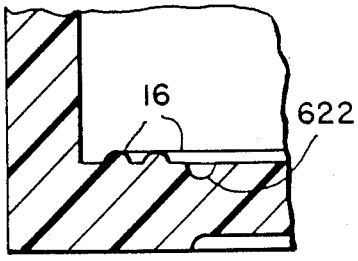

FIGS. 4, 5 and 6 illustrate further possible variations. In FIG. 4, a pair of wavy ribs 16 extend from a frustoconical support wall 424 provided with only one groove hinge 422 along its inner edge, and with no shoulder or ledge.

The embodiment of FIG. 5 is substantially the same as that of FIG. 4, except that a ledge or shoulder 528 is provided. The embodiment of FIG. 6 does not have a tapered or frustoconical support wall for the wavy ribs 16, but like the embodiments of FIGS. 4 and 5 it does have a single hinge groove 622. Further variations will also be readily apparent, e.g. a variation similar to FIG. 6 wherein two hinge grooves are used as in the embodiment 300A of FIG. 3A.

It will be obvious to those skilled in the art that various other changes and modifications may be made without departing from the scope of the invention and the invention is not to be considered limited to what is shown in the drawings and described in the specification.

What is claimed is:

1. A plastic cup for a bottle or jar comprising a top wall having an undersurface, and a circular cylindrical skirt depending downwardly therefrom and having a screw thread on its interior surface; and means for sealing the interior of said cap with a bottle or jar without the use of a liner, said means comprising a plurality of small, fine ribs projecting downwardly from the undersurface of the top wall of said cap so as to contact the upper edge of the bottle or jar mouth, said ribs extending about the periphery of the undersurface of said cap, at least one of said ribs being wavy.

2. A cap according to claim 1 wherein a plurality of said ribs are wavy.

3. A cap according to claim 2 wherein said plurality of wavy ribs define sine waves of consistent amplitude and frequency.

4. A cap according to claim 1 wherein said wavy rib defines a sine wave of consistent amplitude and frequency.

5. A cap according to claim 1 wherein the periphery of said top wall supporting said plurality of downwardly depending ribs has a frustoconical configuration.

6. A cap according to claim 5 further comprising hinge means for permitting said frustoconical periphery to flex.

7. A cap according to claim 1 wherein said periphery of said top wall supporting said plurality of ribs is provided with hinge means for permitting said periphery to flex.

* * * * *